United States Patent [19]

Williams

[11] Patent Number: 4,565,506

[45] Date of Patent: Jan. 21, 1986

[54] HAND OPERATED VACUUM PUMP

[75] Inventor: Danny L. Williams, Clarinda, Iowa

[73] Assignee: Lisle Corporation, Clarinda, Iowa

[21] Appl. No.: 589,140

[22] Filed: Mar. 13, 1984

[51] Int. Cl.[4] ..... F04B 23/00; F04B 21/04; F01B 29/00

[52] U.S. Cl. ..... 417/440; 417/554; 417/566; 417/63; 92/128; 92/164

[58] Field of Search ..... 417/63, 306, 437, 440, 417/550, 559, 566, 554; 92/128, 164, 171

[56] References Cited

U.S. PATENT DOCUMENTS

| | | | |
|---|---|---|---|
| Re. 25,873 | 10/1965 | Rutherford | 92/128 X |
| 1,118,963 | 12/1914 | Stage | 92/164 X |
| 1,697,206 | 1/1929 | Roberts | 417/554 |
| 2,049,872 | 8/1936 | Sera | 417/437 X |
| 2,687,910 | 8/1954 | Petch et al. | 417/437 |
| 2,895,424 | 7/1959 | Tramontini et al. | 417/566 |
| 3,094,939 | 6/1963 | Smith, Sr. et al. | 417/554 X |
| 3,494,652 | 2/1970 | Langland | 92/128 X |
| 3,612,722 | 10/1971 | Neward | 417/63 |
| 3,650,182 | 3/1972 | Phillips | 92/164 X |
| 3,730,217 | 5/1973 | Gute | 137/512.4 |
| 4,357,858 | 11/1982 | Wedman | 92/128 |

FOREIGN PATENT DOCUMENTS

| | | | |
|---|---|---|---|
| 188428 | 1/1957 | Fed. Rep. of Germany | 417/559 |
| 520396 | 3/1955 | Italy | 417/571 |
| 350332 | 6/1931 | United Kingdom | 417/571 |

*Primary Examiner*—Carlton R. Croyle
*Assistant Examiner*—Paul F. Neils
*Attorney, Agent, or Firm*—Allegretti, Newitt, Witcoff & McAndrews, Ltd.

[57] ABSTRACT

An improved hand-operated vacuum pump is disclosed and includes a cylinder, head assembly, and elastic seal member. The cylinder and head assembly define opposing grooves, and the elastic seal member is positioned in the grooves to secure the head assembly to the cylinder. A piston assembly is operative within the cylinder to draw a vacuum within the head assembly.

6 Claims, 3 Drawing Figures

Fig. 1
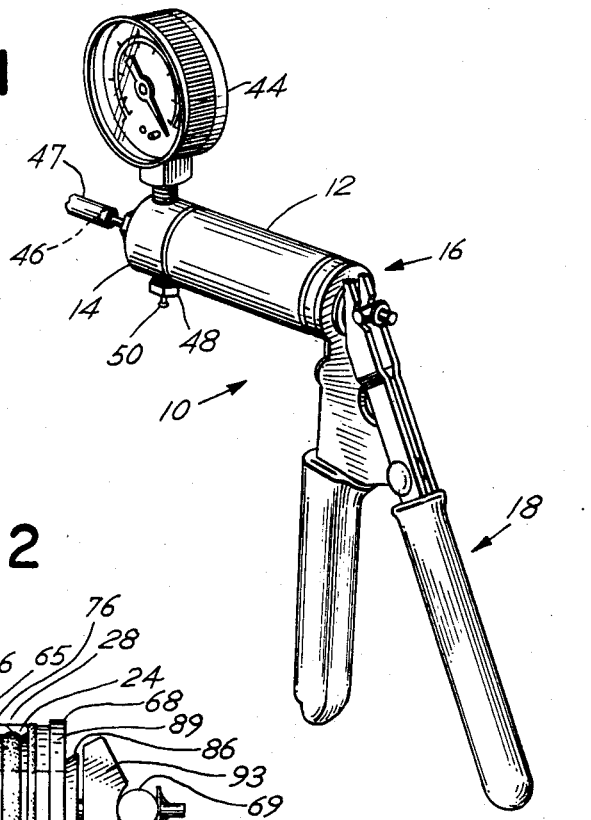
Fig. 2
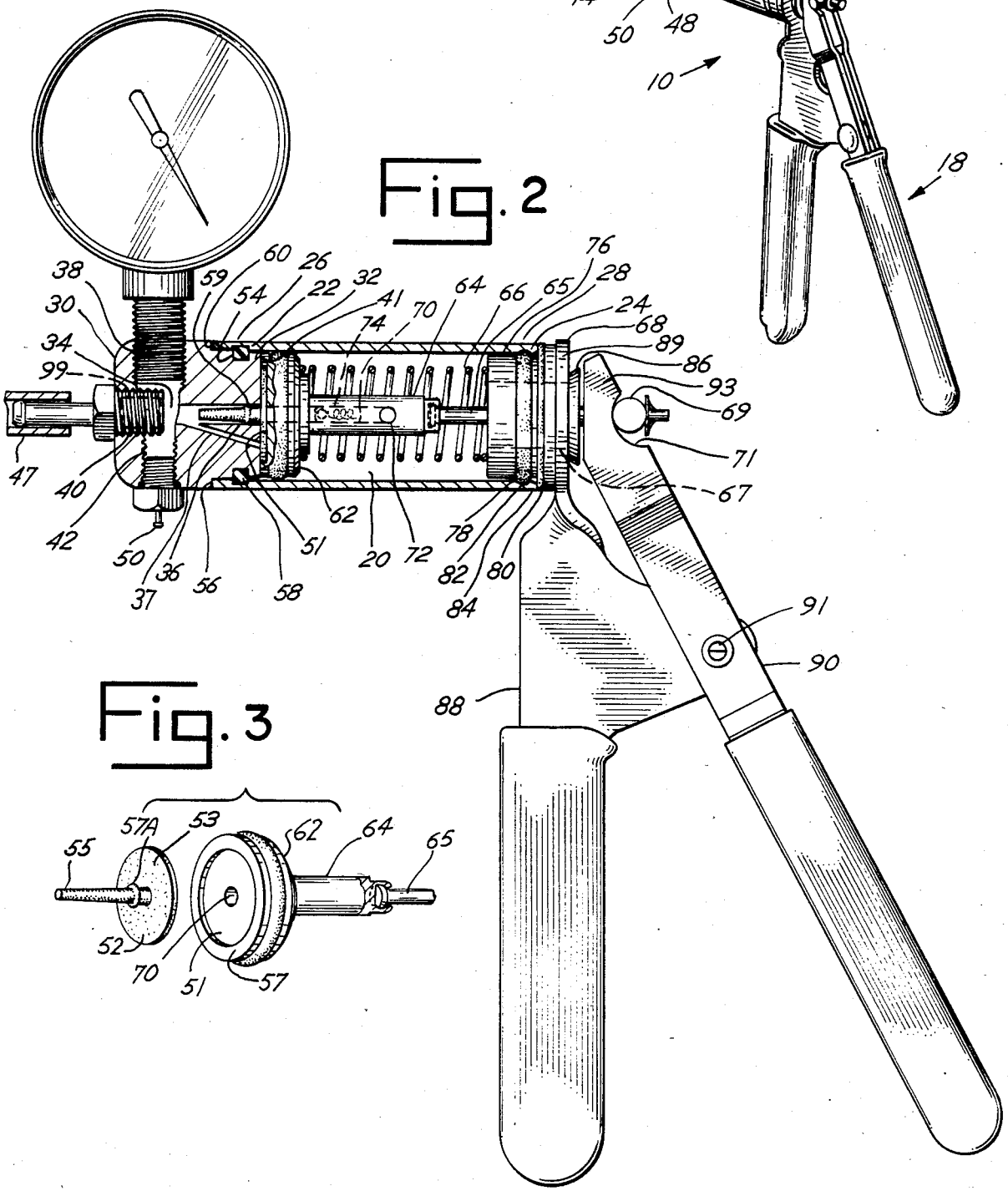
Fig. 3

HAND OPERATED VACUUM PUMP

BACKGROUND OF THE INVENTION

The present invention relates generally to a vacuum pump and more particularly to a hand-operated vacuum pump.

There are presently available a variety of hand-operated vacuum pumps. Two such pumps are shown in U.S. Pat. No. 3,612,722 and United Kingdom Pat. No. 350,332, and the respective teachings thereof are incorporated herein by reference.

The available hand-operated vacuum pumps are effective in terms of operation. Also, these vacuum pumps are inexpensive since many of the components therein are molded plastic. However, a molded plastic construction is not especially durable and may break or become inoperative when used with various solvents or in a hostile environment. Thus, a need has arisen for a highly durable hand operated vacuum pump made at a reasonable cost.

SUMMARY OF THE INVENTION

In a principal aspect, the present invention is an improved hand-operated vacuum pump which is readily manufactured and assembled. The design of the structural components of the present invention is simple in terms of fabrication, and the assembly process is substantially facilitated by the locking interaction of components.

More particularly, the improved hand-operated vacuum pump includes a piston assembly (i.e., a piston, driving rod, guide and appropriate valving) operative within a cylinder. The piston assembly is actuated by a manually-operated drive mechanism.

At the vacuum-drawing end, the cylinder is sealingly closed by a head assembly and an elastic seal member. The elastic seal member is positioned within and engages a pair of opposed grooves defined by the cylinder and head assembly. As such, the assembly process, i.e., the interconnection of the head assembly to the cylinder, is greatly facilitated in that the head assembly "snaps" into the cylinder. Also, the component parts may be made of corrosion resistant and durable metals.

It is thus an object of the present invention to provide an improved hand-operated vacuum-pump. Another object is to provide an improved hand-operated vacuum pump whereby the assembly process is expedited by the locking, snap-together cooperation of structural components. Still another object is to provide an inexpensive, readily maintainable vacuum pump assembly.

These and other features, objects and advantages of the present invention are set forth or implicit in the following description.

BRIEF DESCRIPTION OF THE DRAWING

A preferred embodiment of the present invention is described, in detail, with reference to the drawing wherein:

FIG. 1 is a perspective view of a preferred embodiment of the present invention;

FIG. 2 is a partial cross-sectional, partial schematic view of the preferred embodiment shown in FIG. 1; and FIG. 3 is an exploded perspective view of the valve construction associated with the embodiment of the present invention.

DETAILED DESCRIPTION OF A PREFERRED EMBODIMENT

A preferred embodiment of the present invention is shown in FIGS. 1 and 2 as a hand-operated vacuum pump, generally designated 10. The vacuum pump 10 includes, as its major components, a cylinder 12, head assembly 14, piston assembly 16, and drive mechanism 18, all preferably fabricated from metal parts.

The cylinder 12 defines a passageway or throughbore 20 as well as a pair of inner circumferential cylinder grooves 22, 24. The cylinder grooves 22, 24 lie in a plane substantially perpendicular to the axis of the throughbore 20. As best shown in FIG. 2, the cylinder grooves 22, 24 are located near or adjacent a first end 26 and a second end 28 of the cylinder 12, respectively. The cylinder grooves 22, 24 are preferably rectangular in cross section, having a width-to-depth ratio of approximately two (2).

As shown, the head assembly 14 effectively closes and seals the first end 26 of the cylinder 12. The head assembly 14 is substantially cylindrical in construction, having an external head section 30 and a reduced diameter cylinder-engaging head section 32. The head assembly 14 defines an internal vacuum cavity 34 within the external head section 30 connected by an inclined fluid flow passage 37 extending from the vacuum cavity 34 through the cylinder-engaging head section 32. A sintered metal filter 99 or other type of filter may be positioned in cavity 34.

Three threaded passageways 38, 40, 42 also extend through the external head section 30 of the head assembly 14 and communicate with the vacuum cavity 34. The first passageway 38 is adapted to receive a vacuum gauge 44; the second passageway 40 receives a connector 46 for attachment of a vacuum line 47; and the third passageway 42 receives a vacuum release valve 48. The vacuum release valve 48 is normally closed and may be opened by depression of a manual release pin 50.

An umbrella or flapper check valve 52 is located substantially on the inside planar surface or face 41 of section 32. Valve 52 is fabricated from a flexible material such as rubber and includes a flexible disc shaped flapper 53 with a rearwardly projecting stem 55. As shown in FIG. 3, stem 55 includes a circumferential shoulder 57A compatible with a stepped hole or groove 59 in a stem passage 36. Passage 36 extends into section 32 along the center line axis of section 32. The stem 55 inserted into the passage 36 orients and maintains flapper 53 on face 41. Fluid flow passage 37 connects the cavity 34 through the face 41 of section 32. The opening of the passage 37 is normally covered by the flapper 53.

As shown in FIG. 2, the cylinder-engaging head section 32 of the head assembly 14 is adapted to closely match the first end 26 of the cylinder 12 in terms of shape and dimensions. This congruency facilitates the assembly process and provides a readily sealable interface.

The cylinder-engaging head section 32 includes or defines an outer circumferential head groove 54 and a head land or sealing surface 56. The configuration of the head groove 54 is preferably substantially the mirror image of the cylinder groove 22 of the cylinder 12. In the assembled state, the grooves 22, 54 substantially align, in an opposed relationship, and the head land 56 virtually abuts the first end 26 of the cylinder 12, so as to further facilitate assembly of the vacuum pump 10. The head land 56 also limits the insertion of the head assembly 14 during assembly to ensure alignment of the grooves 22, 54.

The hand-operated vacuum pump 10 further includes a first elastic seal member 58 for retaining or locking the head assembly 14 within the cylinder 12. As best shown in FIG. 2, the first elastic seal member 58 is preferably a uniform diameter O-ring seal adapted to substantially fill the grooves 22, 54 in the assembled state, thereby achieving interlock. As such, the elastic seal member 58 holds the head assembly 14 in a sealed, mechanically fixed relation with respect to the cylinder 12.

To enhance the seal between the cylinder 12 and head assembly 14, the hand-operated vacuum pump 10 includes a first circular seal 60, interposed the first end 26 of the cylinder 12 and the head land 56.

During assembly, the circular seal 60 is slipped over the cylinder-engaging head section 32 and against the head land 56. The O-ring seal member 58 is positioned within the head groove 54. The cylinder-engaging head section 32 is then manipulated into the cylinder 12 until the O-ring seal member 58 engages the cylinder groove 22, completing the interlock and the cylinder 12 seals against seal 60 and land 56. The assembly process is thus simple and quickly accomplished.

The piston assembly 16 operates in cooperation with the cylinder 12 in a conventional manner. The piston assembly 16 includes a piston 62 slideably and sealingly mounted with a circumferential O-ring in the cylinder 12. With hand operation of the drive mechanism 18, the piston 62 reciprocates towards and away from the head assembly 14. The front face 57 of the piston 62 has a counterbore 51 to accommodate the flapper 53.

The piston assembly 16 further includes an integral, axially aligned piston driving rod 64, a spring 66, and a spring retainer and handle support 68. As shown in FIG. 2, the piston driving rod 64 includes a through-bore passage 70. The rod 64 projects from the back side of the piston 62 and is connected at its free or outer end to a shaft 65, that fits into the end of passage 70 and is crimped onto the shaft 65. Shaft 65, in turn, connects with the drive mechanism 18. The spring 66 is interposed between guide 68 and biases piston 62 towards the head assembly 14 so that the piston 62 substantially abuts the head assembly 14 when the assembly 16 is in the at-rest position. The shaft 65 extends through the large diameter opening 67 in the spring retainer and guide 68. The space between the rod 65 and guide 68 permits exhaust flow from piston 62.

The passage 70 extends through the piston 62 and the piston driving rod 64 as previously described. Preferably, the piston fluid passage 70 extends substantially coaxially with the piston driving rod 64 and connects with a transverse exhaust passage 72.

A piston valve 74 is positioned within the piston fluid passage 70. The piston valve 74 conventional is a one-way, unidirectional or check valve, preferably a spring-biased ball valve as shown schematically in FIG. 2, that permits passage fluid (usually air) to flow from the piston 62, through the piston fluid passage 70, and out the exhaust passage 72. Thus, the piston valve 74 relieves pressure between the head assembly 14 and the piston assembly 16 as the piston 62 moves toward the section 32 in response to the force of spring 66.

Like the head assembly 14, the support 68 includes a cylinder-engaging guide section 76, a guide groove 78 on the cylinder-engaging guide section 76, and a guide land 80. The piston guide 68 interlocks with the cylinder 12 by means of a second elastic seal member 82, again preferably an O-ring seal, which engages the grooves 24, 78. A second circular seal 84 interposes and seals the interface between the second end 28 of the cylinder 12 and the guide land 80.

In this preferred embodiment, the piston guide 68 further includes a flange extension 86, adapted to receive the fixed handle 88 and also act as a stop for the drive mechanism 18 or movable handle 90. Thus, the drive mechanism 18 includes a first, fixed handle 88 held in position by the cylindrical extension 86 which is extended through a circular opening in the plate end 89 and is crimped over the plate end 89.

A second movable handle 90, is pivotally connected to the fixed handle 88 at pivot 91. The shaft 65 is connected to working end 93 of the movable handle 90 by a transverse, cylindrical pin 69 which rides in a larger diameter detent 71, such that actuation of the drive mechanism 18 draws the piston 62 away from the head assembly 14. The detent 71 permits movement of the end 93 of the handle 90 relative to the pin 69 as the handle 90 pivots. Thus, the pin 69 slides along the surface of detent 71 so that shaft 65 may remain in straight axial alignment.

In operation, the pump of the present invention operates in the following manner. First, the free end of the hose 47 is attached to the system which is being pumped. Of course, the opposite end of the hose 47 fits over the fitting 46. Next, the movable handle 90 is pivoted about pivot axis 91 to move the piston 62 against the force of the compression spring 66. This creates a low pressure region behind the piston 62 causing fluid to flow through the tube 47 into the fitting 46 through the cavity 34 and passage 37 past the flapper 53 which is flexed to the open position by movement of the fluid and into the cylinder 12. During this stroke of the piston 62, the valve 74 remains in the closed position as does the valve in the passage 42.

Upon completion of the stroke of the piston 62 in response to pivoting the handle 90, the handle 90 is released and the spring 66 causes the piston 62 to return toward its seated position. Note that the stroke of the piston 62 may be limited by the coaction of the end 93 of the handle 90 with the crimped extension 86. Alternatively, the piston 62 may bottom on the face 41 of section 32. In any event, upon the return stroke of the piston 62, the valve 74 opens to release pressure from inside the cylinder 12. Simultaneously, the flapper 53 is compressed against the surface 41 and closes the opening to the passage 37. This maintains the vacuum within the cavity 34 and exhausts the chamber between the piston 62 and the cylinder head 14. Continued oscillations of the handle 90 cause an increased pumping action and will operate to provide at least a partial vacuum as measured on the gauge 44 in cavity 34.

As illustrated, the present invention is a simple, easily fabricated, easily assembled hand-operated vacuum pump. The structure of the cylinder 12, head assembly 14, and piston guide 68 facilitates and expedites the assembly process by providing a quick, "snap-together" fit.

A single preferred embodiment of the present invention has been described herein. It is to be understood, however, that certain changes and modifications can be made without departing from the true scope and spirit of the present invention as defined by the foregoing specification and following claims.

What is claimed is:

1. A hand-operated vacuum pump comprising, in combination:

a cylinder having a throughbore and defining a first inner circumferential cylinder groove at least at one end thereof;

a head assembly defining a vacuum cavity and a fluid flow passage therein, said head assembly including a cylinder-engaging head section having a shape and dimensions substantially congruent with said one end of said cylinder, said cylinder-engaging section defining an outer circumferential head groove, said first inner circumferential cylinder groove and said outer circumferential head groove being in an opposed relation in an assembly state, said head assembly including a flapper check valve in communication with said fluid flow passage for permitting substantially unidirectional flow through said fluid flow passage from said vacuum cavity, said flapper check valve including a flexible disc against a face of said head section and over said fluid flow passage and a stem attached to said flexible disc, said stem being attached to said cylinder-engaging head section to hold said flexible disc in position to function as a valve, said head assembly further including a connector in communication with said vacuum cavity and a release valve in communication with said vacuum cavity;

a first elastic seal member positioned within said first inner circumferential cylinder groove and said outer circumferential head groove in said assembled state to retain said head assembly in sealed and mechanically fixed relation to said cylinder;

a piston assembly operative within said cylinder to draw a vacuum in said vacuum cavity; and manual drive means, attached to said cylinder and said piston assembly, for actuating said piston assembly, said piston assembly including a piston slidable within said cylinder, a piston driving rod, and a piston guide, said piston driving rod interconnecting said piston and said manual drive means through said piston guide, said piston including a piston fluid passage, said piston assembly further including a piston valve within said piston fluid passage for permitting substantially unidirectional flow through said piston fluid passage.

2. A hand-operated vacuum pump as claimed in claim 1 wherein said head assembly further defines a head land to limit insertion of said cylinder-engaging head section into said cylinder to substantially ensure said opposed relation.

3. A hand-operated vacuum pump as claimed in claim 1 wherein first elastic seal member is a uniform diameter O-ring seal.

4. A hand-operated vacuum pump as claimed in claim 3 wherein said uniform diameter O-ring seal substantially fills said inner circumferential cylinder groove and said outer circumferential head groove.

5. A hand-operated vacuum pump as claimed in claim 1 wherein said cylinder further defines a second inner circumferential cylinder groove opposite said one end thereof, said piston guide having a cylinder-engaging guide section defining an outer circumferential guide groove, said second inner circumferential cylinder groove and said outer circumferential guide groove being in opposed relation in said assembled state.

6. A hand-operated vacuum pump as claimed in claim 5 further comprising a second elastic seal member positioned within said second inner circumferential cylinder groove and said outer circumferential guide groove in said assembled state to retain said piston guide in fixed relation to said cylinder.

* * * * *